US006663137B2

(12) United States Patent
Karlsen

(10) Patent No.: US 6,663,137 B2
(45) Date of Patent: Dec. 16, 2003

(54) SNOWBOARD

(76) Inventor: Jørgen Karlsen, Helmerveien 1, Hovik (NO), N-1322

( * ) Notice: Subject to any disclaimer, the term of this patent is extended or adjusted under 35 U.S.C. 154(b) by 0 days.

(21) Appl. No.: 10/176,848

(22) Filed: Jun. 20, 2002

(65) Prior Publication Data

US 2002/0195780 A1 Dec. 26, 2002

Related U.S. Application Data

(63) Continuation of application No. 09/623,713, filed as application No. PCT/NO99/00032 on Feb. 4, 1999, now abandoned.

(30) Foreign Application Priority Data

Mar. 10, 1998 (NO) ..... 981056

(51) Int. Cl.[7] ..... A63C 5/04
(52) U.S. Cl. ..... 280/609; 280/14.22
(58) Field of Search ..... 280/602, 607, 280/609, 14.21, 14.22

(56) References Cited

U.S. PATENT DOCUMENTS

| | | | | |
|---|---|---|---|---|
| 2,510,794 | A | 6/1950 | Beerli | |
| 4,700,967 | A | 10/1987 | Meatto et al. | 280/609 |
| 4,795,184 | A | 1/1989 | Diard et al. | 280/609 |
| 4,971,349 | A | 11/1990 | Diard et al. | |
| 4,971,350 | A | 11/1990 | Fagot | |
| 5,018,760 | A | 5/1991 | Remondet | |
| 5,135,249 | A | 8/1992 | Morris | |
| 5,242,187 | A | 9/1993 | Diard et al. | |
| 5,286,051 | A | 2/1994 | Scherübl | |
| 5,303,949 | A | 4/1994 | Harper et al. | |
| 5,340,144 | A | 8/1994 | Eleneke | |
| 5,462,304 | A | 10/1995 | Nyman | |
| 5,511,815 | A | 4/1996 | Karlsen | |
| D379,647 | S | 6/1997 | Levinthal | D21/766 |
| D386,236 | S | 11/1997 | Gervasoni | D21/766 |

(List continued on next page.)

FOREIGN PATENT DOCUMENTS

| | | |
|---|---|---|
| AT | 144 066 | 12/1935 |
| CH | 351 882 | 3/1961 |

(List continued on next page.)

OTHER PUBLICATIONS

International Search Report for PCT/NO99/00032 dated Jul. 4, 1999.
International Search Report for PCT/NO92/00020 dated May. 6, 1992.

(List continued on next page.)

*Primary Examiner*—Brian L. Johnson
*Assistant Examiner*—Bryan Fischmann
(74) *Attorney, Agent, or Firm*—Merchant & Gould, P.C.

(57) ABSTRACT

A snowboard comprises a board and bindings mounted on the board's surface. The board is designed with a first sole surface which is divided into three portions between the tips, and which is flat along its entire length between the transitions to the tips when the board is pressed down against the base. In the front and rear portions, on each side of the first sole surface, the sole of the snowboard includes secondary lateral areas (2). In the secondary lateral areas (2), the cross section will form substantially straight lines. The secondary areas are rigid and not in contact with the ground unless the board is edged. The angle that the secondary lateral areas form with the first sole surface viewed in cross section, will substantially be increasing when moving from the transverse lines (5 or 7) towards the transition to the tips (4 or 8).

8 Claims, 6 Drawing Sheets

U.S. PATENT DOCUMENTS

| | | | | |
|---|---|---|---|---|
| 5,727,807 | A | 3/1998 | Kraft et al. | 280/609 |
| 5,782,482 | A | 7/1998 | Andrus et al. | |
| 5,871,224 | A | 2/1999 | Vance | |
| 5,876,056 | A | 3/1999 | Karlsen | |
| 5,906,388 | A | 5/1999 | Neiley | |
| 5,941,553 | A | 8/1999 | Korman | |
| 5,957,480 | A | 9/1999 | Dodge | |
| D414,832 | S | 10/1999 | Shields | D21/760 |
| 5,967,542 | A | 10/1999 | Williams et al. | |
| 5,971,407 | A | 10/1999 | Zemke et al. | |
| 5,984,343 | A | 11/1999 | Longoni et al. | |
| 6,029,991 | A | 2/2000 | Frey | |
| 6,042,126 | A | 3/2000 | Muller et al. | |
| 6,102,428 | A | 8/2000 | Bobrowicz | |
| 6,293,567 | B1 | 9/2001 | Menges | |
| 6,481,741 | B1 * | 11/2002 | Porte | 280/609 |
| 6,502,850 | B1 * | 1/2003 | Schaller et al. | 280/602 X |

FOREIGN PATENT DOCUMENTS

| | | | |
|---|---|---|---|
| CH | 662 744 | | 10/1987 |
| CH | 668000 | | 11/1988 |
| DE | 435 061 | | 10/1926 |
| DE | 1958349 | | 5/1971 |
| DE | 2403944 | | 1/1974 |
| DE | 29 24 023 | | 12/1980 |
| DE | 3441058 | | 5/1986 |
| DE | 36 00 862 | | 7/1986 |
| DE | 36 07 808 | A1 | 9/1987 |
| DE | 296 05 153 | U1 | 11/1996 |
| EP | 0 253 660 | | 1/1988 |
| EP | 0 579 865 | | 1/1994 |
| EP | 0608185 | | 7/1994 |
| EP | 0 570 467 | | 1/1995 |
| EP | 0 778 053 | A2 | 6/1997 |
| EP | 0 748 245 | B1 | 10/1998 |
| FR | 2559673 | | 8/1985 |
| NO | 172170 | | 3/1993 |
| NO | 301964 | | 5/1998 |
| SE | 88 426 | | 2/1937 |
| WO | WO 89/10167 | | 11/1989 |
| WO | WO 92/13609 | | 8/1992 |
| WO | WO 95/21662 | | 8/1995 |

OTHER PUBLICATIONS

International Search Report for PCT/NO95/00030 dated May. 22, 1995.

Notice of References Cited dated Jul. 25, 1994.

Notice of References Cited dated Mar. 12, 1995.

* cited by examiner

SNOWBOARD

The invention relates to a snowboard, consisting of a board on which two bindings are mounted on the surface of the board, at a distance apart approximately corresponding to ⅓ of the board's length. The board is designed with inwardly curving edge portions, the board having a greater width at both ends at the transition to the tips, and with a minimum width of 18 cm in the middle. The board has upturned tips, possibly with a slightly more moderate tip at one end.

BACKGROUND

At present snowboards are normally designed with a flat sole surface between the tips at both ends. For steering the board is edged and the weight distributed between the feet in the two bindings.

Alpine skiing is a field which is related to snowboarding. In Alpine pair skis it is known to have the sole surfaces designed with angled portions in partial areas of the sole surface.

Thus in Norwegian patent no. 172 170 there is disclosed an Alpine ski, of a pair of skis, which on a maximum 20 cm long front portion has a gliding surface which diverges upwards when the steel edge diverges outwards from the ski's longitudinal axis. The object of this ski is to turn with the least possible loss of kinetic energy. In patent no. PCT/NO95/00030 there is disclosed an Alpine ski, which on a portion which is longer than 20 cm has a gliding surface which diverges upwards when the steel edge diverges outwards from the ski's longitudinal axis. The object of this ski is to turn with the least possible loss of kinetic energy, but in this case with a more harmonious design than in that which is described in Norwegian patent no. 172 170.

In Norwegian patent no. 301 964, which corresponds to EP 748245 there is disclosed an Alpine pair ski with a flat first sliding surface and lateral surfaces provided with an almost continuous concave inward curve between a first transition line which defines the transition from a tip portion to a front portion and a second transition line which defines the transition from the main portion to a rear portion. The lower lateral edge between the transition lines describes an almost continuous curve. The sole on both sides of the first sliding surface comprises further sliding surfaces, which extend upwards from the edge of the first sliding surface to the lower lateral edges of the ski with an upward curve. The additional sliding surfaces extend in the longitudinal direction of the ski, at least from the first and second transition lines respectively towards a transverse line behind the middle of the ski and in the portion of the ski where the binding is attached, the width of the ski at the transverse line being equal to the least width of the ski between the transition lines. The upward curve in the lower lateral edge on the additional sliding surfaces increases substantially with the ski's increasing width in the direction of the two transition lines.

An Alpine ski as described in this publication has been shown to be very well suited to Alpine events and the angled sliding surfaces, which even with a relatively slight edging of the ski can be pressed into contact with the base, giving improved turning technique and grip on the base.

The present invention is based on the development of Alpine skis which is described in Norwegian patent no. 301964. Even though both skis and snowboards are used for downhill skiing and turning in Alpine terrain, there are nevertheless significant differences. This difference is based both on the difference in design of the two products and on the manner in which the product maneuvers. In skis the weight is distributed with a foot in a binding in the central portion of each ski and the ski, which is elongated and relatively narrow, at least for most of its length, will, when a pressure load is applied in the central area, be able to be forced to assume different positions against the base. In the case of a snowboard the performer stands with both feet on a substantially wider board and he will steer the board by bodily movements and by distributing his weight between the front and the rear of the board. Since the board is wider and shorter and the weight distribution different the board will not only be more rigid than a ski but will also be steered in a different way.

SUMMARY

In the present invention it has been found that a number of the principles which have been developed in connection with the ski according to Norwegian patent no. 301964 in modified and developed form can be employed for further development of a snowboard, resulting in a marked improvement in their handling characteristics.

On this basis, therefore, it is the object of the invention to provide an improved snowboard. This is achieved by means of a snowboard which is characterized by the features which will be presented in the patent claims.

The snowboard according to the present invention differs from the above-mentioned, known ski designs in the requirement, amongst other things, that the secondary lateral areas of the board should be substantially tapered. By being tapered it should be understood that the angle of the lateral area against the base, viewed in the transverse direction of the board, increases from the central portion up to the front area at the tips.

From the dynamic point of view a snowboard differs from a ski in many ways, for reasons of both design and mode of application, as indicated above. A ski with a certain inward curve will be twisted upwards at the tip and rear tip when edged, since the skier presses with his foot in the middle of the ski and the counter-forces from the base will twist the ski, reducing the aggressiveness at the front and the rear due to the fact that the sole is flatter against the snow at the front and the rear than in the middle. In contrast with this the performer on a snowboard will stand with both feet placed not so far from the tips, with the result that in relative and absolute terms the snowboard has less length than the ski to generate a twisting moment. It will therefore not be so easy to twist the snowboard. It is therefore absolutely necessary to give the snowboard a dynamically correct shape at the manufacturing stage. This is achieved according to the invention by combining dimensions which are specific to the snowboard with selected features which are known to be employed in connection with skis, since these selected features together will give the snowboard an optimal dynamic adaptation. Thus it is the combination of the features indicated in the patent claims which make it possible to utilise the features known from skis for an improvement of an alternative product, viz. a snowboard.

There is therefore a fundamental difference between ski and board, and in the invention it has surprisingly been shown that by means of adaptation and modification of features known from the field of skis with regard to the design of twisted surfaces, it has been possible to develop a snowboard which is adapted to the dynamics which apply to skis.

When the tapered board according to the invention is placed on the snow, it can already have a better dynamic shape than the surface the board is capable of achieving, since the board according to the invention is produced with a twisting tapering of the sole adapted to where the weight is actually paced on the board, with regard to the ideal twisting tapering which is desired.

It has further been shown that there are significant safety aspects associated with a specific design of raised sliding surfaces with regard to landing after jumping with the snowboard. It is a fact that falls with snowboards result in many injuries, which are far more serious than the speed would indicate. The snowboard according to the present invention is also designed to increase safety in landing after a jump, due to the fact that it is not so aggressive in the edge area during landing.

The more curved the steel edge in the snowboard's edge area is, the greater tendency it has to cut away in an uncontrolled fashion when landing after a jump, especially when making an almost flat landing. The invention will therefore provide greater safety benefits the more inward curve the snowboard has. By allowing the board to be almost flat along its entire width from the central portion a reasonable edge grip can also be secured when the board is flat against the snow. On the front and rear portions of the board the right and left parts of the sole are tapered upwards, thus providing a less aggressive steel edge, but at the same time the board has to be formed in such a manner that it has a good edge grip when turning. Thus a boat shape, in which the cross section shows curved lines near the steel edge will be unsuitable, since the angle at the steel edge will then be too large to give a good edge grip. The snowboard described with a cross section in the front and rear portions consisting of three straight lines (FIG. 2) will ensure both a less aggressive edge grip during landing after a jump and adequate edge rip during turning.

The width is a further significant difference between ski and snowboard. A narrow ski can easily be edged 45°. The much wider snowboard is usually run much flatter than a ski. A great deal of edge grip will therefore easily be lost with a snowboard when the secondary surfaces are too acutely angled relative to the first sole surface. The invention solves this special problem for snowboards by means of the special design of raised lateral area from the following criteria:

1. The secondary lateral area must have a certain minimum width which is greater than for most skis, thus achieving a greater uplift with less angling of the secondary lateral area relative to the first sole surface.
2. The secondary lateral area is raised from the plane of the main area by being tapered upwards when moving from the middle towards the tips.
3. The cross section shows the sole as three substantially straight lines in those parts of the board where there are secondary lateral areas.

DESCRIPTION OF THE DRAWINGS

The invention will now be illustrated in more detail by means of the embodiments which are presented in the drawings, in which.

DETAILED DESCRIPTION

Figure 1:
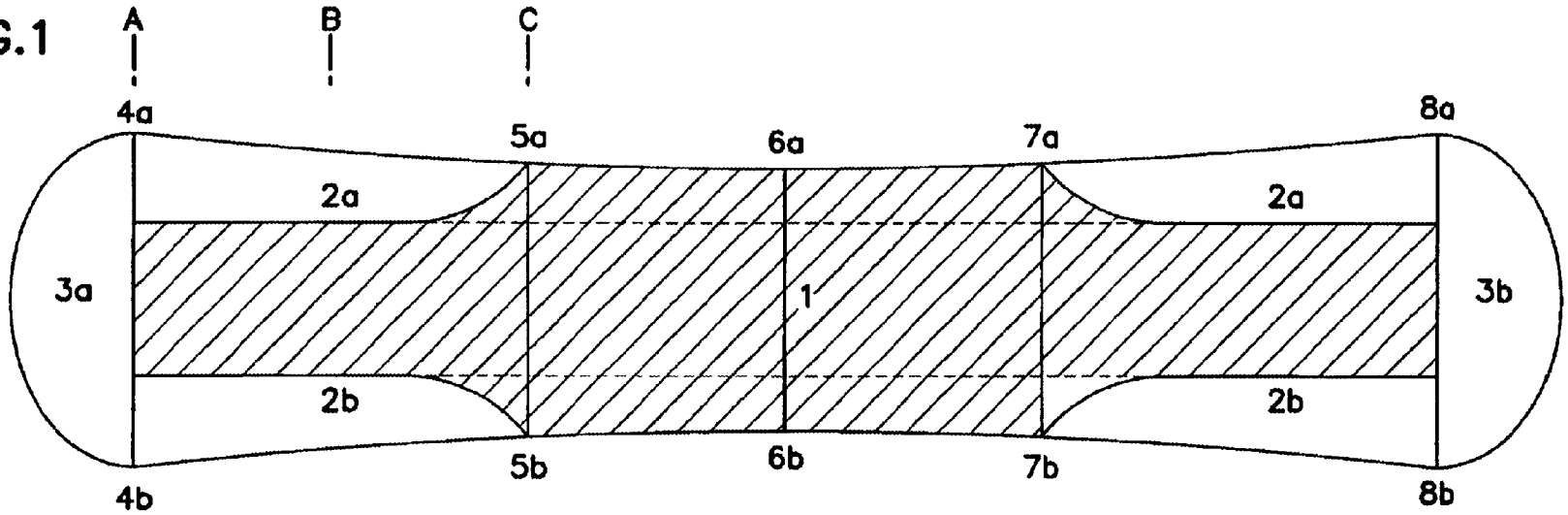
FIG. 1 illustrates the underside of a snowboard according to the invention.
Figure 2:
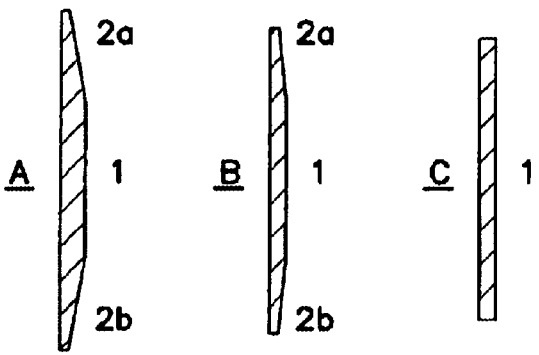
FIG. 2 is a cross section of the snowboard in FIG. 1, viewed across the board in the areas indicated by A, B C.

FIG. 1 illustrates the underside of a snowboard. The hatched gliding surface 1, called the main area, is completely flat when the board is pressed against a flat base. The secondary lateral areas 2*a* and 2*b* in line 5*a*—5*b* are level with the main area, and up to line 4*a*—4*b* form a substantially increasing angle with the main area, viewed in cross section as shown in FIG. 2. In the same way the secondary lateral areas 2*c* and 2*d* in line 7*a*—7*b* are level with the main area, and up to line 8*a*—8*b* form a substantially increasing angle with the main area. The secondary lateral areas 2*a*, 2*b*, 2*c*, and 2*d* therefore appear to be twisted tapered, if not over the entire length, to such an extent that they have the function of a tapered surface. The front tip 3*a* and rear tip 3*b* and central transversal axis 6*l*–6*b* are also shown.

FIG. 2 illustrates three cross sections of the snowboard in FIG. 1, taken directly across from FIG. 1. In order to illustrate the increasing angle from line 5*a*–5*b* to line 4*a*–4*b* the angles are slightly exaggerated, thus making it easy to see that there is a larger angle nearest line 4*a*–4*b*. In cross section the sole surfaces are shown to be completely straight, even though in the transition between first sole surface and the secondary lateral areas there may be a certain degree of rounding.

Figure 3:
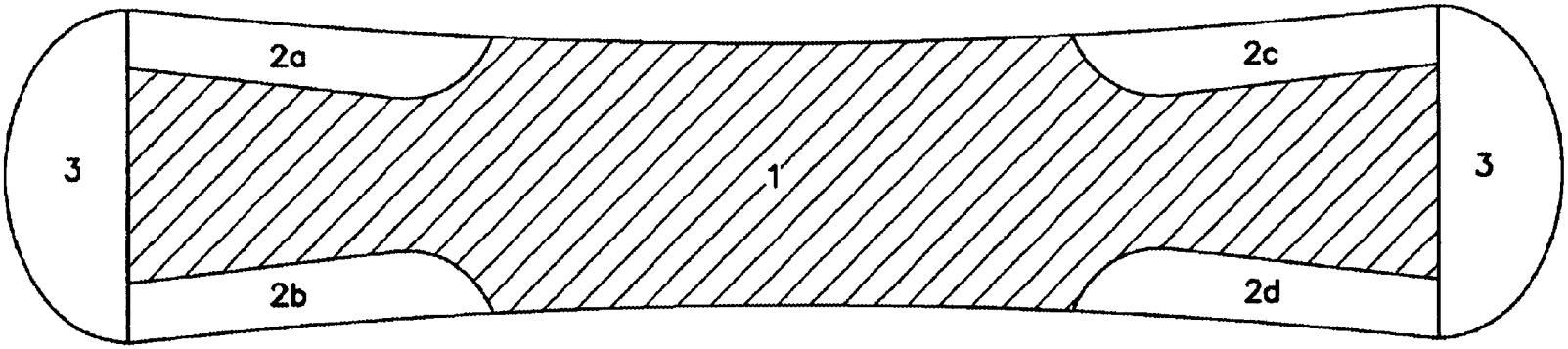
FIG. 3 is a variant of the embodiment in FIG. 1.

FIG. 3 illustrates a design in which the secondary lateral areas are terminated reasonably parallel to the steel edge.

Figure 4:
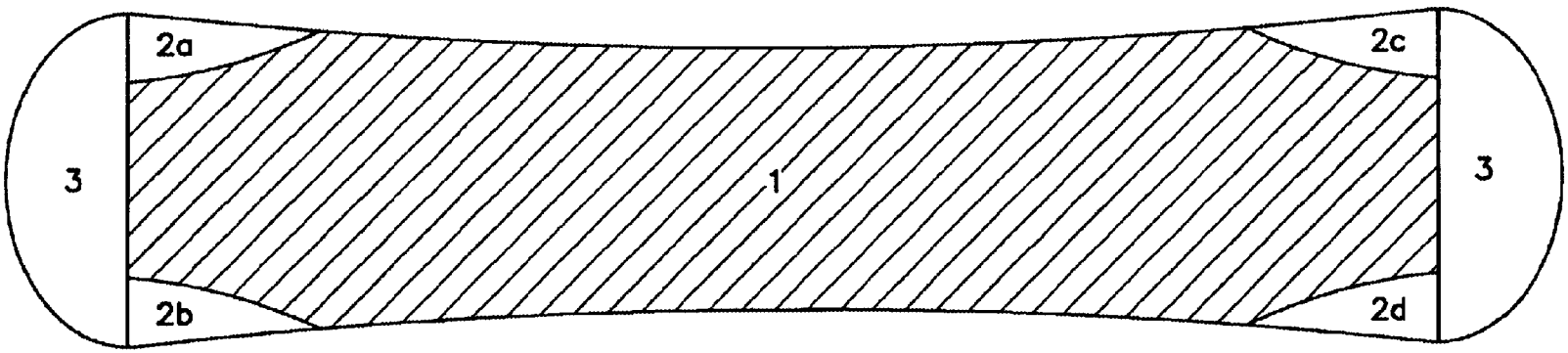
FIG. 4 is a further variant of the invention.

FIG. 4 illustrates a design in which the secondary lateral areas are widest at the transition to the tips at lines 4*a*–4*b* and 8*a*–8*b* respectively, gradually narrowing as one approaches lines 5*a*—5*b* and 7*a*–7*b* respectively. In this embodiment the degree to tapering will be less than in the other embodiments which are illustrated.

Figure 5:
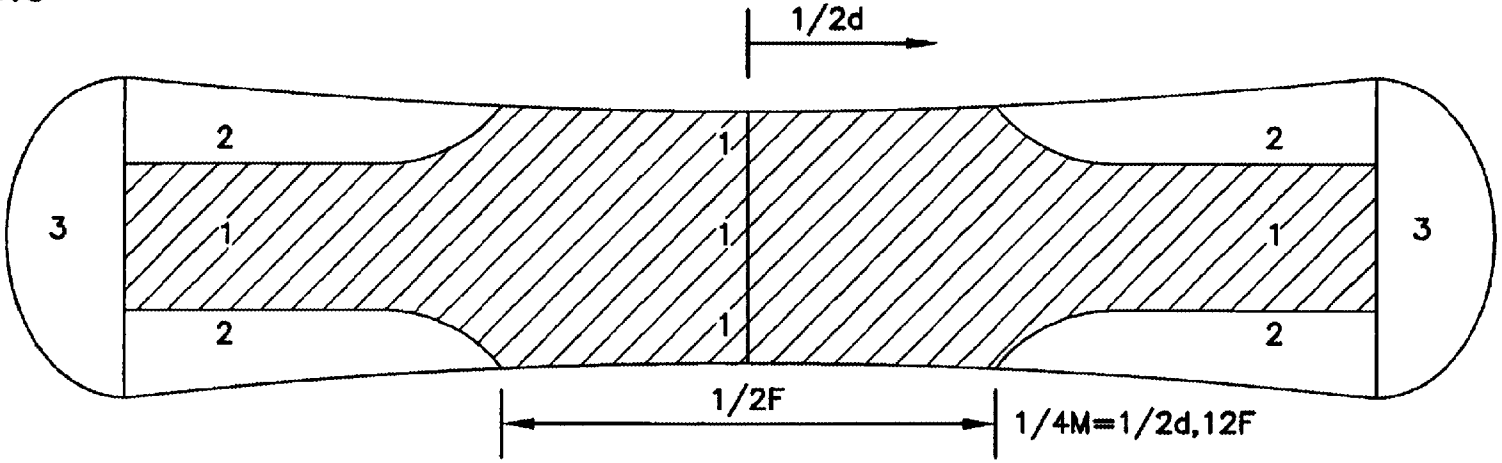
FIG. 5 is a variant of the embodiment in FIG. 1.

FIG. 5 illustrates approximately the same design as FIG. 1. Here the board is envisaged moving straight ahead with the board completely flat against a hard base. Only the steel edges outside the main area plane 1 are then in contact with the snow, while the performer's weight is envisaged evenly distributed over the entire length of the main area plane. As an illustration we have chosen to let the central portion of the snowboard be the same length as the sum of he length of the secondary lateral areas on the same side. Thus the lengths 4*a*–5*a* and 7*a*–8*a* are here equal to 5*a*–7*a*, and correspondingly on the opposite side. Using the equation where torque (M)=force (F)×distance (d). F/2 is the force from the base on the steel edge over half the lengths of the board, while d/2 is the average distance from the center 6 of the performer to the force's point of attach on one side. M indicates torque.

Figure 6:
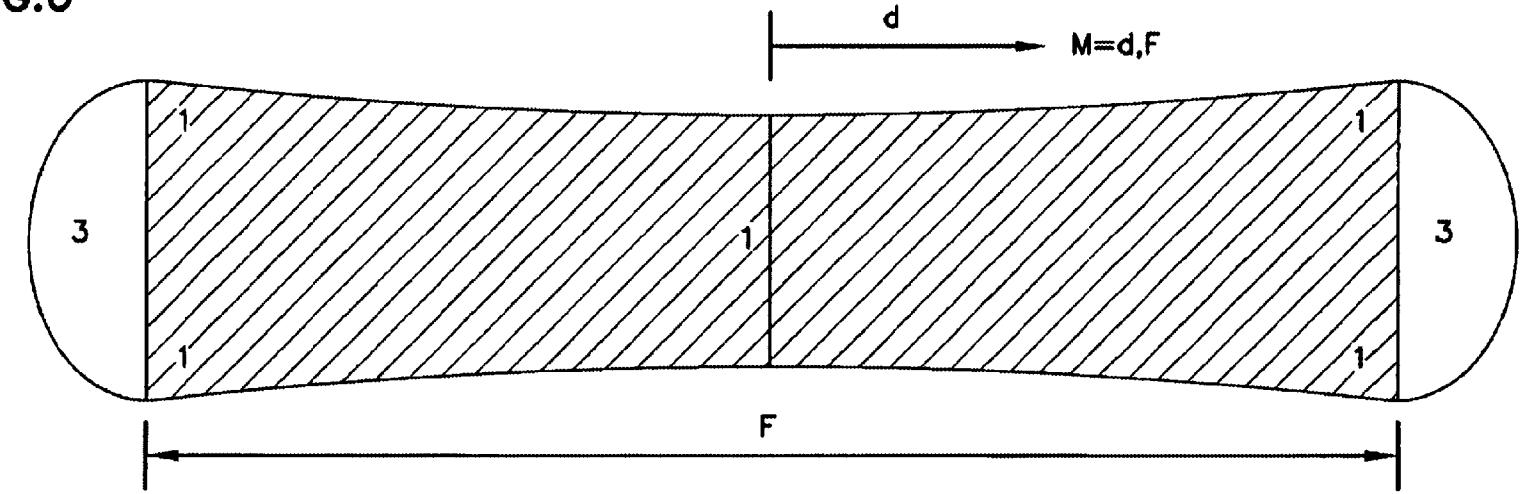
FIG. 6 is a variant of the embodiment in FIG. 5.

FIG. 6 illustrates the same design as FIG. 5, but with a completely flat sole. F is the force from the base on the steel edge along the entire length of the board, while d is the average distance from the centre 6 of the performer to the force's point of attack on one side. M indicates torque.

Figure 7:
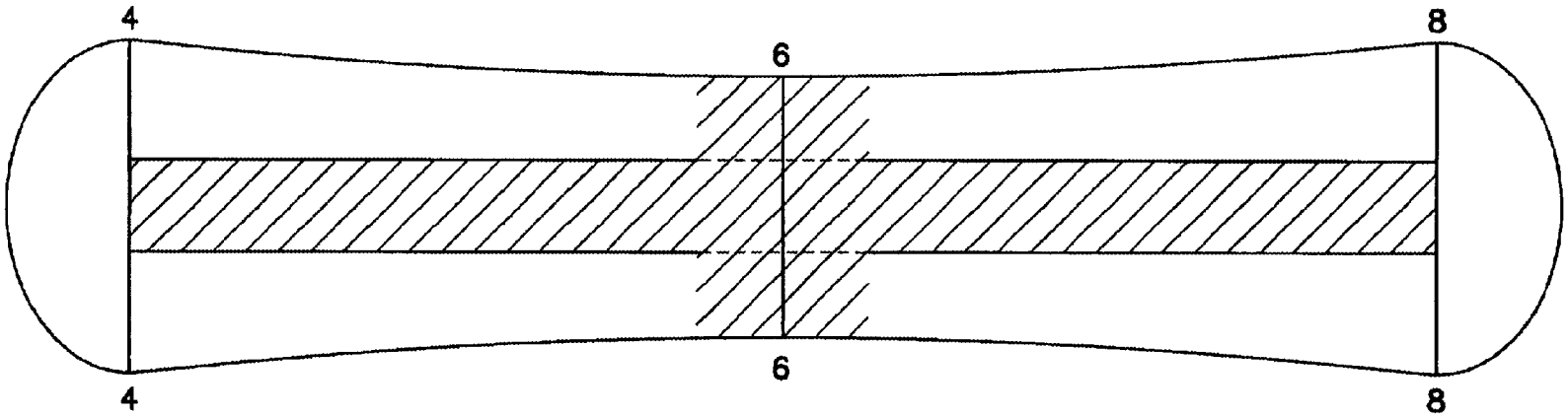
FIG. 7 is a further variant of the invention.
Figure 8:
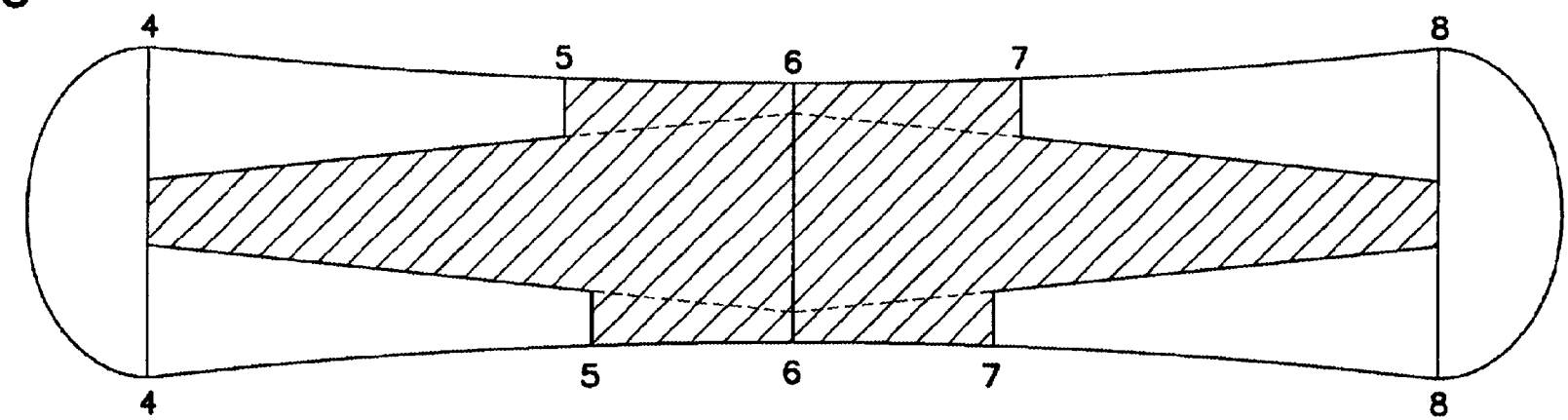
FIG. 8 is a further variant of the invention.

FIGS. 7 and 8 illustrate two further examples of snowboards designed according to the invention. In the embodiment according to FIG. 7 the hatched sole surface, i.e. the main area is designed with equal, relatively narrow width along the whole board, but ahs a central portion at line 6—6 which makes a "soft" transition into the lateral areas. A certain degree of asymmetry in the secondary areas in indicated, even though symmetry is preferred. In the embodiment in FIG. 8 the hatched main area surface is designed narrowing from line 6—6 to end lines 4—4 and 8—8, which is first illustrated from lines 5—5 and 7—7. The portion of the main area surface between these two lines is continued right out to the edge. In all embodiments the lateral areas are designed in a tapered form.

The illustrated examples will provide boards which have different handling characteristics, but will all provide the special advantage which is achieved by means of the invention.

Figure 9:
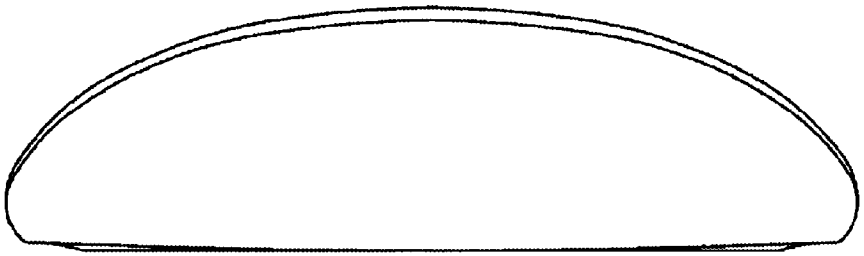
FIGS. 9 and 10 illustrate the snowboard according to the invention, viewed from the side and from one end.
Figure 10:
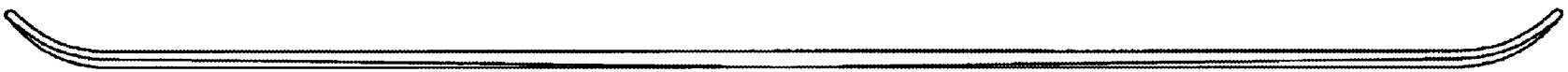

Finally, FIGS. 9 and 10 illustrate the snowboard according to the invention, viewed from the side and from one of the ends. On this scale the angles had to be exaggerated relative to the preferred angle in order to clearly illustrate the principle. In FIG. 10 the tapering of the lateral areas can be seen indicated on the underside, with the maximum angle in the transition to the tip. Also shown are two bindings 10 mounted on the board's upper surface at a distance apart corresponding to approximately ⅓ of the board's length.

Figure 11:
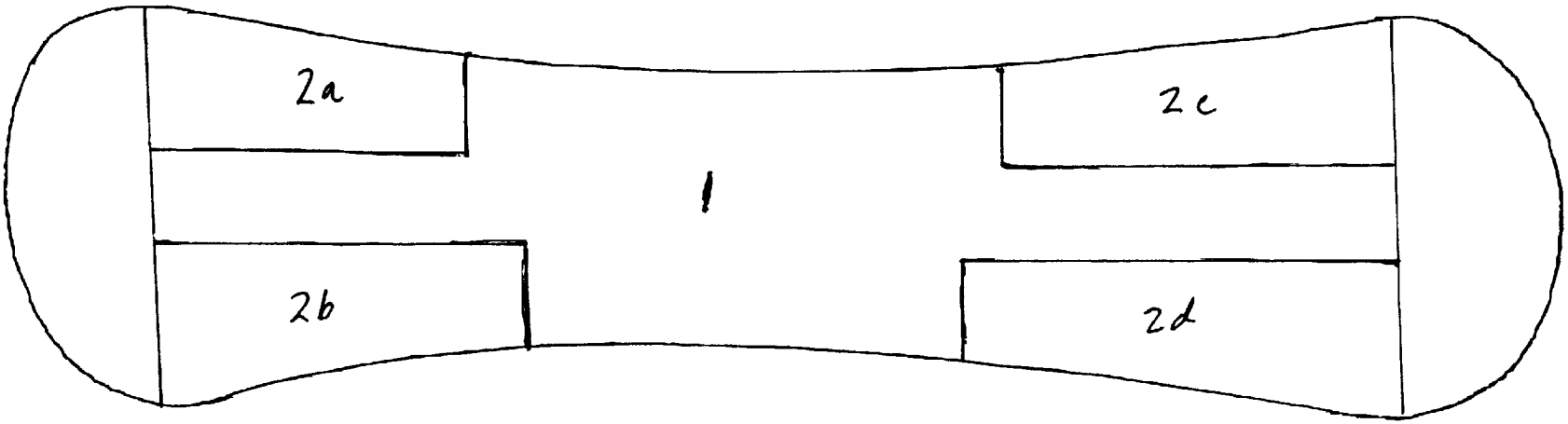
FIG. 11 is a further variant of the invention.

Four tables are now presented illustrating the tapering angle for the lateral areas in the snowboard according to the invention. Thus table 1 gives four examples of snowboards with a constant cross section for the first sole surface. Table 2 exemplifies an embodiment with constant width for the secondary lateral areas, while table 3 gives the angle for boards with variable with for the first sole surface in the secondary lateral areas. Table 4 and FIG. 11 illustrates examples of asymmetrical snowboards.

It should be obvious from the above that despite the choice and combination of special features which are partly known from ski technology, many modifications are possible. Further development according to the invention is based on the combination of selected features in such a manner that a result is obtained which is unique for snowboards. In the invention a selection of features and dimensions have been made which together provide an improvement.

TABLE 1

Four examples of a snowboard with a constant width of the first base surface. For simplicity we use in these examples snowboards with circular sidecut. and symmetry along both the longitudinal and transversal central axis.

| Total width at (8) (mm) 290 | Total width at (6) (mm) 250 | | Length (6)–(8) (mm) 650 Width of each secondary lateral area (mm) | Length (6)–(4) (mm) 650 | | Sidecut radius (mm) 10,573 | |
|---|---|---|---|---|---|---|---|
| | | | | Cross sectional angle between main area and secondary lateral areas (degrees) | | | |
| Distance from the tip (mm) | Total width (mm) | Width of the main area (mm) | | Example 1 | Example 2 | Example 3 | Example 4 |
| 0 | | | | | | | |
| 50 | | | | | | | |
| 100 | | | | | | | |
| 150 | 290.0 | 80.0 | 105.0 | 3.0 | 1.0 | 2.0 | 2.2 |
| 200 | 284.1 | 80.0 | 102.0 | 2.7 | 0.7 | 1.9 | 2.2 |
| 250 | 278.6 | 80.0 | 99.3 | 2.4 | 0.3 | 1.8 | 2.1 |
| 300 | 273.7 | 80.0 | 96.8 | 2.1 | 0 | 1.7 | 2 |
| 350 | 269.2 | 80.0 | 94.6 | 1.8 | 0 | 1.6 | 1.8 |
| 400 | 265.1 | 80.0 | 92.6 | 1.5 | 0 | 1.5 | 1.6 |
| 450 | 261.6 | 80.0 | 90.8 | 1.2 | 0 | 1.4 | 1.4 |
| 500 | 258.5 | 80.0 | 89.3 | 0.9 | 0 | 1.2 | 1.2 |
| 550 | 255.9 | 80.0 | 88.0 | 0.6 | 0 | 0.9 | 1 |
| 600 | 253.8 | 80.0 | 86.9 | 0.3 | 0 | 0.6 | 0.8 |
| 650 | 252.1 | 80.0 | 86.1 | 0 | 0 | 0.3 | 0.6 |
| 700 | 250.9 | 80.0 | 85.5 | 0 | 0 | 0 | 0.4 |
| 750 | 250.2 | 80.0 | 85.1 | 0 | 0 | 0 | 0.2 |
| 800 | 250.0 | 80.0 | 85.0 | 0 | 0 | 0 | 0 |
| 850 | 250.2 | 80.0 | 85.1 | 0 | 0 | 0 | 0.2 |
| 900 | 250.9 | 80.0 | 85.5 | 0 | 0 | 0 | 0.4 |
| 950 | 252.1 | 80.0 | 86.1 | 0 | 0 | 0.3 | 0.6 |
| 1000 | 253.8 | 80.0 | 86.9 | 0.3 | 0 | 0.6 | 0.8 |
| 1050 | 255.9 | 80.0 | 88.0 | 0.6 | 0 | 0.9 | 1.0 |
| 1100 | 258.5 | 80.0 | 89.3 | 0.9 | 0 | 1.2 | 1.2 |
| 1150 | 261.6 | 80.0 | 90.8 | 1.2 | 0 | 1.4 | 1.4 |
| 1200 | 265.1 | 80.0 | 92.6 | 1.5 | 0 | 1.5 | 1.6 |
| 1250 | 269.2 | 80.0 | 94.6 | 1.8 | 0 | 1.6 | 1.8 |
| 1300 | 273.7 | 80.0 | 96.8 | 2.1 | 0 | 1.7 | 2.0 |
| 1350 | 278.6 | 80.0 | 99.3 | 2.4 | 0.3 | 1.8 | 2.0 |
| 1400 | 284.1 | 80.0 | 102.0 | 2.7 | 0.7 | 1.9 | 2.1 |
| 1450 | 290.0 | 80.0 | 105.0 | 3.0 | 1.0 | 2.0 | 2.1 |
| 1500 | | | | | | | |
| 1550 | | | | | | | |
| 1600 | | | | | | | |

Where the angle between the secondary lateral area and the main area is zero, the main area extends to the steel edge, and the "Width of the main area" equals the "Total Width." The secondary lateral area is not lateral in this part, and the width of the secondary lateral area is shown because it varies from example to example. Where the angles is zero, the width of the secondary lateral area is also zero.

TABLE 2

Four examples of a snowboard with a constant width of the first base surface. For simplicity we use in these examples snowboards with circular sidecut. and symmetry along both the longitudinal and transversal central axis.

| Total width at (8) (mm) | Total width at (6) (mm) | Length (6)–(8) (mm) | Length (6)–(4) (mm) | Sidecut radius (mm) |
|---|---|---|---|---|
| 290 | 245 | 650 Width of each | 650 | 9,400 |

| Distance from the tip (mm) | Total width (mm) | Width of the main area (mm) | secondary lateral area (mm) | Cross sectional angle between main area and secondary lateral areas (degrees) Example 5 | Example 6 | Example 7 | Example 8 |
|---|---|---|---|---|---|---|---|
| 0 | | | | | | | |
| 50 | | | | | | | |
| 100 | | | | | | | |
| 150 | 290.0 | 140.0 | 75.0 | 3.5 | 1.0 | 2.0 | 3 |
| 200 | 283.3 | 133.3 | 75.0 | 3.1 | 0.8 | 1.9 | 2.7 |
| 250 | 277.2 | 127.2 | 75.0 | 2.7 | 0.6 | 1.8 | 2.4 |
| 300 | 271.6 | 121.6 | 75.0 | 2.3 | 0.4 | 1.7 | 2.1 |
| 350 | 266.6 | 116.6 | 75.0 | 1.9 | 0.2 | 1.6 | 1.8 |
| 400 | 262.0 | 112.0 | 75.0 | 1.6 | 0 | 1.5 | 1.6 |
| 450 | 258.0 | 108.0 | 75.0 | 1.3 | 0 | 1.4 | 1.4 |
| 500 | 254.6 | 104.6 | 75.0 | 1.0 | 0 | 1.2 | 1.2 |
| 550 | 251.7 | 101.7 | 75.0 | 0.7 | 0 | 0.9 | 1 |
| 600 | 249.3 | 99.3 | 75.0 | 0.4 | 0 | 0.6 | 0.8 |
| 650 | 247.4 | 97.4 | 75.0 | 0.2 | 0 | 0.3 | 0.6 |
| 700 | 246.1 | 96.1 | 75.0 | 0 | 0 | 0 | 0.4 |
| 750 | 245.3 | 95.3 | 75.0 | 0 | 0 | 0 | 0.2 |
| 800 | 245.0 | 95.0 | 75.0 | 0 | 0 | 0 | 0 |
| 850 | 245.3 | 95.3 | 75.0 | 0 | 0 | 0 | 0.2 |
| 900 | 246.1 | 96.1 | 75.0 | 0 | 0 | 0 | 0.4 |
| 950 | 247.4 | 97.4 | 75.0 | 0.2 | 0 | 0.3 | 0.6 |
| 1000 | 249.3 | 99.3 | 75.0 | 0.4 | 0 | 0.6 | 0.8 |
| 1050 | 251.7 | 101.7 | 75.0 | 0.7 | 0 | 0.9 | 1.0 |
| 1100 | 254.6 | 104.6 | 75.0 | 1.0 | 0 | 1.2 | 1.2 |
| 1150 | 258.0 | 108.0 | 75.0 | 1.3 | 0 | 1.4 | 1.4 |
| 1200 | 262.0 | 112.0 | 75.0 | 1.6 | 0 | 1.5 | 1.6 |
| 1250 | 266.6 | 116.6 | 75.0 | 1.9 | 0.2 | 1.6 | 1.8 |
| 1300 | 271.6 | 121.6 | 75.0 | 2.3 | 0.4 | 1.7 | 2.1 |
| 1350 | 277.2 | 127.2 | 75.0 | 2.7 | 0.6 | 1.8 | 2.4 |
| 1400 | 283.3 | 133.3 | 75.0 | 3.1 | 0.8 | 1.9 | 2.7 |
| 1450 | 290.0 | 140.0 | 75.0 | 3.5 | 1.0 | 2.0 | 3.0 |
| 1500 | | | | | | | |
| 1550 | | | | | | | |
| 1600 | | | | | | | |

Where the angle between the secondary lateral area and the main area is zero, the main area extends to the steel edge, and the "Width of the main area" equals the "Total Width." The secondary lateral area is not lateral in this part, and the width of the secondary lateral area is shown because it varies from example to example. Where the angles is zero, the width of the secondary lateral area is also zero.

TABLE 3

Four examples of a snowboard with a constant width of the first base surface. For simplicity we use in these examples snowboards with circular sidecut. and symmetry along both the longitudinal and transversal central axis.

| Total width at (8) (mm) | Total width at (6) (mm) | Length (6)–(8) (mm) | Length (6)–(4) (mm) | Sidecut radius (mm) |
|---|---|---|---|---|
| 280 | 240 | 600 Width of each | 600 | 9,010 |

| Distance from the tip (mm) | Total width (mm) | Width of the main area (mm) | secondary lateral area (mm) | Cross sectional angle between main area and secondary lateral areas (degrees) Example 9 | Example 10 | Example 11 | Example 12 |
|---|---|---|---|---|---|---|---|
| 0 | | | | | | | |
| 50 | | | | | | | |
| 100 | | | | | | | |
| 150 | 280.0 | 40.0 | 120.0 | 2.0 | 0.8 | 1.2 | 1.8 |
| 200 | 273.6 | 50.0 | 111.8 | 1.8 | 0.6 | 1.1 | 1.6 |
| 250 | 267.8 | 60.0 | 103.9 | 1.6 | 0.4 | 1.0 | 1.4 |

TABLE 3-continued

Four examples of a snowboard with a constant width of the first base surface. For simplicity we use in these examples snowboards with circular sidecut. and symmetry along both the longitudinal and transversal central axis.

| Total width at (8) (mm) | Total width at (6) (mm) | Length (6)–(8) (mm) | Length (6)–(4) (mm) | Sidecut radius (mm) |
|---|---|---|---|---|
| 280 | 240 | 600 | 600 | 9,010 |

| Distance from the tip (mm) | Total width (mm) | Width of the main area (mm) | Width of the secondary lateral area (mm) | Cross sectional angle between main area and secondary lateral areas (degrees) Example 9 | Example 10 | Example 11 | Example 12 |
|---|---|---|---|---|---|---|---|
| 300 | 262.5 | 70.0 | 96.2 | 1.4 | 0.2 | 0.9 | 1.2 |
| 350 | 257.8 | 80.0 | 88.9 | 1.2 | 0 | 0.8 | 1 |
| 400 | 253.6 | 90.0 | 81.8 | 1 | 0 | 0.7 | 0.8 |
| 450 | 250.0 | 100.0 | 75.0 | 0.8 | 0 | 0.6 | 0.6 |
| 500 | 246.9 | 110.0 | 68.5 | 0.6 | 0 | 0.5 | 0.4 |
| 550 | 244.4 | 120.0 | 62.2 | 0.4 | 0 | 0.4 | 0.3 |
| 600 | 242.5 | 130.0 | 56.2 | 0.2 | 0 | 0.3 | 0.2 |
| 650 | 241.1 | 140.0 | 50.6 | 0 | 0 | 0.2 | 0.1 |
| 700 | 240.3 | 150.0 | 45.1 | 0 | 0 | 0.1 | 0 |
| 750 | 240.0 | 160.0 | 40.0 | 0 | 0 | 0.0 | 0 |
| 800 | 240.3 | 150.0 | 45.1 | 0 | 0 | 0.1 | 0 |
| 850 | 241.1 | 140.0 | 50.6 | 0 | 0 | 0.2 | 0.1 |
| 900 | 242.5 | 130.0 | 56.2 | 0.2 | 0 | 0.3 | 0.2 |
| 950 | 244.4 | 120.0 | 62.2 | 0.4 | 0 | 0.4 | 0.3 |
| 1000 | 246.9 | 110.0 | 68.5 | 0.6 | 0 | 0.5 | 0.4 |
| 1050 | 250.0 | 100.0 | 75.0 | 0.8 | 0 | 0.6 | 0.6 |
| 1100 | 253.6 | 90.0 | 81.8 | 1.0 | 0 | 0.7 | 0.8 |
| 1150 | 257.8 | 80.0 | 88.9 | 1.2 | 0 | 0.8 | 1.0 |
| 1200 | 262.5 | 70.0 | 96.2 | 1.4 | 0.2 | 0.9 | 1.2 |
| 1250 | 267.8 | 60.0 | 103.9 | 1.6 | 0.4 | 1.0 | 1.4 |
| 1300 | 273.6 | 50.0 | 111.8 | 1.8 | 0.6 | 1.1 | 1.6 |
| 1350 | 280.0 | 40.0 | 120.0 | 2.0 | 0.8 | 1.2 | 1.8 |
| 1400 | | | | | | | |
| 1450 | | | | | | | |
| 1500 | | | | | | | |

Where the angle between the secondary lateral area and the main area is zero, the main area extends to the steel edge, and the "Width of the main area" equals the "Total Width." The secondary lateral area is not lateral in this part, and the width of the secondary lateral area is shown because it varies from example to example. Where the angles is zero, the width of the secondary lateral area is also zero.

TABLE 4

An example of an asymmetric snowboard.
For simplicity we use in these examples snowboards with circular sidecut.

| Total width at (8) (mm) | Total width at (6) (mm) | Length (6)–(8) (mm) | Length (6)–(4) (mm) | Sidecut radius (mm) |
|---|---|---|---|---|
| 255 | 220 | 750 | 650 | 16,080 |

| Distance from the tip (mm) | Total width (mm) | Width of the main area (mm) | Width of the secondary lateral area (mm) | Cross sectional angle between main area and secondary lateral areas (degrees) Example 13 Example Right | Example Left |
|---|---|---|---|---|---|
| 0 | | | | | |
| 50 | | | | | |
| 100 | | | | | |
| 150 | 255.0 | 80.0 | 87.5 | 2.8 | 2.4 |
| 200 | 250.5 | 80.0 | 85.2 | 2.6 | 2.3 |
| 250 | 246.3 | 80.0 | 83.1 | 2.4 | 2.2 |
| 300 | 242.4 | 80.0 | 81.2 | 2.2 | 2 |
| 350 | 238.8 | 80.0 | 79.4 | 2 | 1.8 |
| 400 | 235.6 | 80.0 | 77.8 | 1.8 | 1.6 |
| 450 | 232.6 | 80.0 | 76.3 | 1.6 | 1.4 |
| 500 | 230.0 | 80.0 | 75.0 | 1.4 | 1.2 |
| 550 | 227.6 | 80.0 | 73.8 | 1.2 | 1 |
| 600 | 225.6 | 80.0 | 72.8 | 1 | 0.8 |

TABLE 4-continued

An example of an asymmetric snowboard.
For simplicity we use in these examples snowboards with circular sidecut.

| Total width at (8) (mm) | Total width at (6) (mm) | Length (6)–(8) (mm) | Length (6)–(4) (mm) | Sidecut radius (mm) |
|---|---|---|---|---|
| 255 | 220 | 750 | 650 | 16,080 |

| Distance from the tip (mm) | Total width (mm) | Width of the main area (mm) | Width of the secondary lateral area (mm) | Cross sectional angle between main area and secondary lateral areas (degrees) Example 13 Example Right | Example Left |
|---|---|---|---|---|---|
| 650 | 223.9 | 80.0 | 71.9 | 0.8 | 0.6 |
| 700 | 222.5 | 80.0 | 71.2 | 0.6 | 0.4 |
| 750 | 221.4 | 80.0 | 70.7 | 0.4 | 0.2 |
| 800 | 220.6 | 80.0 | 70.3 | 0.2 | 0 |
| 850 | 220.2 | 80.0 | 70.1 | 0 | 0 |
| 900 | 220.0 | 80.0 | 70.0 | 0 | 0 |
| 950 | 220.2 | 80.0 | 70.1 | 0 | 0 |
| 1000 | 220.6 | 80.0 | 70.3 | 0 | 0 |
| 1050 | 221.4 | 80.0 | 70.7 | 0.2 | 0 |
| 1100 | 222.5 | 80.0 | 71.2 | 0.4 | 0.2 |
| 1150 | 223.9 | 80.0 | 71.9 | 0.6 | 0.4 |
| 1200 | 225.6 | 80.0 | 72.8 | 0.8 | 0.6 |
| 1250 | 227.6 | 80.0 | 73.8 | 1.0 | 0.8 |
| 1300 | 230.0 | 80.0 | 75.0 | 1.2 | 1.0 |
| 1350 | 232.6 | 80.0 | 76.3 | 1.4 | 1.2 |
| 1400 | 235.6 | 80.0 | 77.8 | 1.6 | 1.4 |
| 1450 | 238.8 | 80.0 | 79.4 | 1.8 | 1.6 |
| 1500 | 242.4 | 80.0 | 81.2 | 2.1 | 1.7 |
| 1550 | 246.3 | 80.0 | 83.1 | 2.2 | 1.8 |
| 1600 | | | | | |

Where the angle between the secondary lateral area and the main area is zero, the main area extends to the steel edge, and the "Width of the main area" equals the "Total Width." The secondary lateral area is not lateral in this part, and the width of the secondary lateral area is shown because it varies from example to example. Where the angles is zero, the width of the secondary lateral area is also zero.

What is claimed is:

1. A snowboard, wherein the snowboard includes a board, the board having two bindings mounted on an upper surface of the board at a distance apart of approximately ⅓ of a length of the board, wherein the board includes inwardly curving edge portions and a width of at least 18 cm, being wider at both of the board's ends than in a middle of the board, the snowboard comprising:

a sole surface divided between the ends in the length direction of the snowboard into three successive portions, a front portion, a central portion, and a rear portion, the sole surface including a main area extending in a middle of the sole surface in the length direction through all three successive portions, the main area being flat when the board is pressed against a ground and having a minimum width of 4 cm in a transverse direction of the snowboard over a length that is sufficient to define the flat; and secondary lateral areas on each side of the main area positioned in the front portion and the back portion and at the transition to the ends, each secondary lateral area being at least 4 cm wide and wherein a combined length of the secondary lateral areas including both the front and rear portions on one side of the snowboard is at least ⅒ of a length of the main area, and wherein the secondary lateral areas are each substantially linear in cross section are rigid, and do not contact the ground unless the board is edged, and wherein each secondary lateral area is positioned at an angle with respect to the main area such that the angle substantially increases from the center portion to the transition to the ends so that each secondary lateral area is tapered to become increasingly elevated with respect to the ground.

2. A snowboard according to claim 1, wherein the width of the main area is at least 6 cm.

3. A snowboard according to claim 1, wherein the combined length of the secondary lateral areas on one side is at least ⅕ of the length of the main area.

4. A snowboard according to claim 1, wherein as the secondary lateral areas are tapered with respect to the main area, the angle formed by the secondary lateral areas with the main area, viewed in a cross section to the snowboard, increases over each 5 cm long interval of the secondary lateral area when displacing the cross section view from the central portion towards the transition to the tips.

5. A snowboard according to claim 1, wherein the board is symmetrical about its longitudinal axis.

6. A snowboard according to claim 1, wherein the board is asymmetrical about its longitudinal axis.

7. A snowboard according to claim 1, wherein the board is symmetrical about its central transversal axis.

8. A snowboard according to claim 1, wherein the board is asymmetrical about its central transversal axis.

* * * * *